US006337010B1

(12) United States Patent
Hofer

(10) Patent No.: US 6,337,010 B1
(45) Date of Patent: Jan. 8, 2002

(54) PROCESS SCHEME FOR PRODUCING LUBRICATING BASE OIL WITH LOW PRESSURE DEWAXING AND HIGH PRESSURE HYDROFINISHING

(75) Inventor: Kevin L. Hofer, Concord, CA (US)

(73) Assignee: Chevron U.S.A. Inc., San Francisco, CA (US)

( * ) Notice: Subject to any disclaimer, the term of this patent is extended or adjusted under 35 U.S.C. 154(b) by 0 days.

(21) Appl. No.: 09/366,037

(22) Filed: Aug. 2, 1999

(51) Int. Cl.[7] ..... C10G 65/12; C10G 71/00

(52) U.S. Cl. ..... 208/58; 208/18; 208/27; 585/738

(58) Field of Search ..... 208/58, 18, 28, 208/142, 143

(56) References Cited

U.S. PATENT DOCUMENTS

| | | | | |
|---|---|---|---|---|
| 3,852,207 A | | 12/1974 | Strangeland et al. | 208/58 |
| 3,968,024 A | | 7/1976 | Gorring et al. | 208/111 |
| 4,157,294 A | | 6/1979 | Iwao et al. | 208/264 |
| 4,283,272 A | | 8/1981 | Garwood et al. | 208/59 |
| 4,347,121 A | * | 8/1982 | Mayer et al. | 208/58 |
| 4,361,477 A | * | 11/1982 | Miller | 208/67 |
| 4,673,487 A | | 6/1987 | Miller, I | 208/58 |
| 4,851,109 A | * | 7/1989 | Chen et al. | 208/58 |
| 4,867,862 A | * | 9/1989 | Ziemer | 208/27 |
| 4,921,594 A | * | 5/1990 | Miller | 208/58 |
| 5,082,986 A | | 1/1992 | Miller, II | 585/667 |
| 5,135,638 A | | 8/1992 | Miller, III | 208/27 |
| 5,275,719 A | * | 1/1994 | Baker, Jr. et al. | 208/58 |
| 5,282,958 A | | 2/1994 | Santilli et al. | 208/111 |
| 5,376,260 A | | 12/1994 | Santilli et al. | 208/111 |
| 5,885,438 A | * | 3/1999 | Apelian et al. | 208/27 |

* cited by examiner

*Primary Examiner*—Bekir L. Yildirim
(74) *Attorney, Agent, or Firm*—Penny L. Prater

(57) ABSTRACT

A process for the production of a UV stable lubricating base oil from a waxy hydrocarbon feedstock comprising the steps of hydrocracking the feedstock; dewaxing the intermediate feedstock from the hydrocracking zone under low pressure; and stabilizing the dewaxed lubricating base oil under high pressure in a hydrofinishing zone.

3 Claims, 1 Drawing Sheet

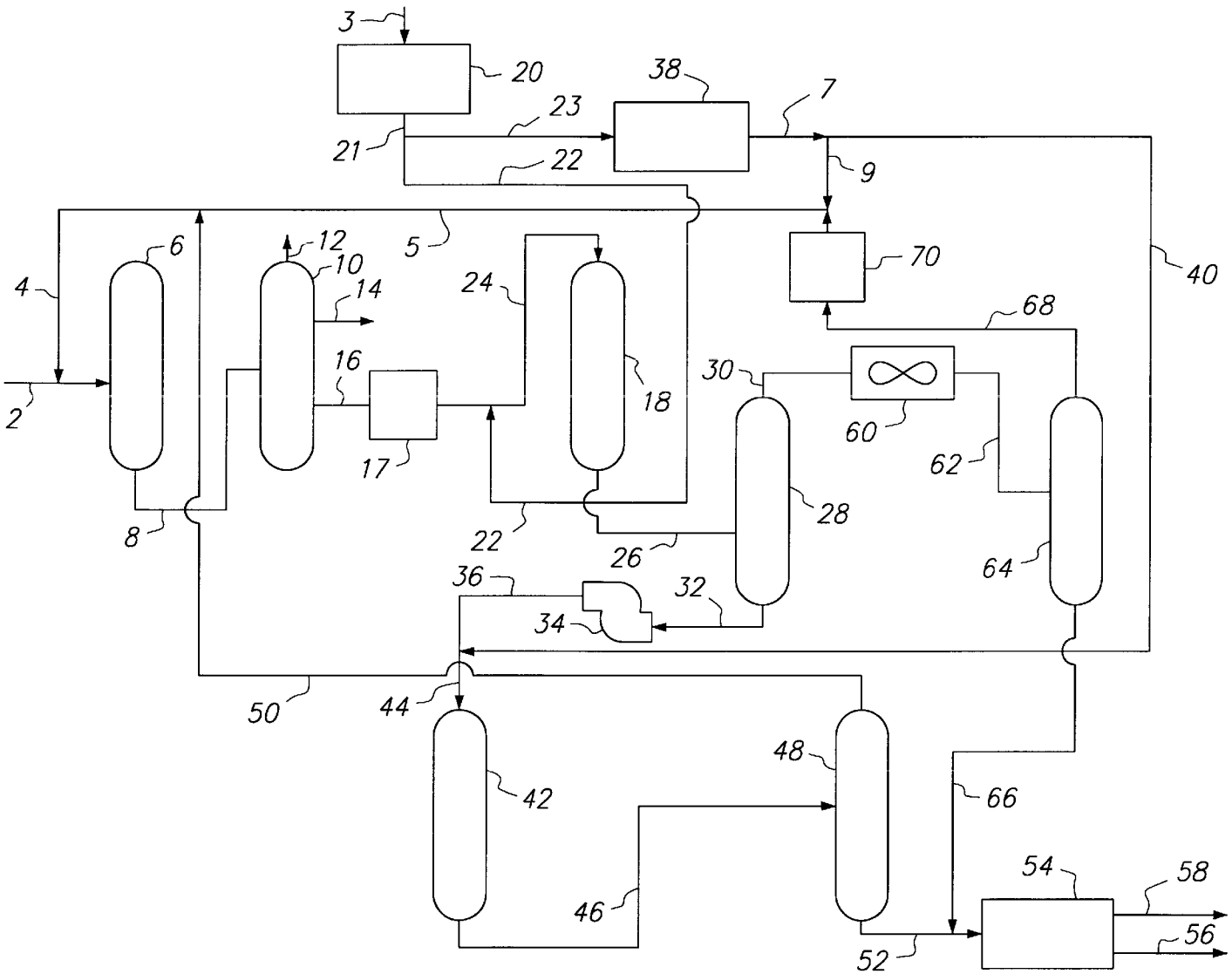
40
58
56
68
64
54
62
66
70
60
52
9
28
7
48
30
38
32
18
26
46
23
22
34
20
24
22
42
36
5
44
3
21
17
14
16
10
12
50
6
8
4
2

PROCESS SCHEME FOR PRODUCING LUBRICATING BASE OIL WITH LOW PRESSURE DEWAXING AND HIGH PRESSURE HYDROFINISHING

FIELD OF THE INVENTION

The present invention relates to the production of a UV stable lubricating base oil from a waxy hydrocarbon feedstock involving the steps of hydrocracking a heavy hydrocarbon feedstock to prepare a waxy hydrocarbon feedstock, dewaxing the waxy hydrocarbon feedstock to produce a lubricating base oil, and hydrofinishing the lubricating base oil to produce a UV stable lubricating base oil.

DESCRIPTION OF THE PRIOR ART

The preparation of lubricating base oils from heavy hydrocarbon feedstocks using the sequential steps of hydrocracking the heavy hydrocarbon feedstock to prepare a waxy intermediate feedstock, catalytically dewaxing the intermediate feedstock to produce a lubricating base oil, and hydrofinishing the lubricating base oil to obtain a UV stabilized lubricating base oil product is well known and is generally described in U.S. Pat. No. 4,283,272. In upgrading hydrocarbon feedstocks to produce a suitable lubricating base oil the lubricating properties of the material must be improved, i.e., the base oil should display a high viscosity index, high thermal stability, oxidation resistance, and a high boiling range. As used in this disclosure the term heavy hydrocarbon feedstock refers to a hydrocarbon boiling above about 650 degrees F. (340 degrees C.) which is suitable for upgrading to a lubricating base oil. As used herein, heavy hydrocarbon feedstock, includes, but is not limited to, petroleum derived feedstocks, such as for example heavy straight run gas oil, deasphalted oil, vacuum gas oil, topped crude oils, atmospheric residuum, or the like. Also useful as possible feedstocks are synthetic hydrocarbons prepared from shale oils, coal, or by Fischer-Tropsch processes. However, feedstocks which are high in asphaltenes, metals, sulfur, and nitrogen will usually require some kind of prior treatment, such as in a hydrotreating operation, before they are suitable for use as a feedstock for the hydrocracking process step. Hydrocracking is a well known process for upgrading hydrocarbon feedstocks for use in the manufacture of lubricating base oils. Hydrocracking operations take place under severe hydrogenation conditions in the presence of excess free hydrogen and a catalyst having good hydrogenation activity. Typically hydrocracking is carried out at temperatures of from about 500 degrees F. (260 degrees C.) to about 900 degrees F. (480 degrees C.), preferably within the range of from about 650 degrees F. (340 degrees C.) to about 800 degrees F. (425 degrees C.). The literature teaches that the pressures in the hydrocracking zone are within the range from about 500 psig to 10,000 psig with the range from about 500 psig to about 3000 psig being preferred. In commercial operations the pressure is almost always in excess of 1500 psig. The hydrogen supply rate (both makeup and recycle) falls within the range of from about 500 to 20,000 standard cubic feet (SCF) per barrel of hydrocarbon feed, preferably in the range from about 2000 to 10,000 SCF. per barrel of hydrocarbon feed. See U.S. Pat. No. 3,852,207. Most hydrocracking operations produce a number of useful products which include transportation fuels, such as jet, kerosene, and naphtha, as well as the feedstocks suitable for upgrading to lubricating base oils. The feedstocks which are suitable for further processing into lubricating base oils are often high in paraffins. Such feedstocks referred to in this disclosure as waxy intermediate feedstocks contain at least 5 percent by weight total wax and, in some cases, may contain greater than 80 percent total wax as in the case with slack wax, deoiled wax, or synthetic liquid polymers. However, usually the feedstock will contain at least 10 percent by weight of wax.

Waxy intermediate feedstocks produced by the hydrocracking operation are characterized by high pour points and high cloud points. In order to prepare commercially useful lubricating base oils from waxy feedstocks the pour point and cloud point must be lowered without compromising the desired viscosity characteristics. Dewaxing operations may employ either solvent dewaxing or catalytic dewaxing processes to improve the lubricating characteristics of the feedstock. The present invention is concerned only with catalytic dewaxing processes, and, more particularly, the present invention is directed only to those catalytic dewaxing processes which employ an isomerization-type of catalyst such as is described in U.S. Pat. Nos. 5,135,638; 5,282,958; and 5,376,260. In isomerization-type dewaxing operations the cracking of the paraffinic components of the hydrocarbon is minimized. The straight chain and slightly branched paraffins are isomerized to more highly branched materials which have more desirable pour point characteristics. By contrast, those catalytic dewaxing operations using a cracking type of catalyst (such as described in U.S. Pat. Nos. 3,894,938; 4,176,050; 4,181,598; 4,222,855; 4,229,282; and 2,247,388) crack the straight chain and slightly branched paraffins into smaller molecules which are subsequently removed. In commercial operations, the dewaxing operation is carried out at a relatively high pressure. Typically in commercial lube production plants, the hydrocracking operation, the catalytic dewaxing operation and the hydrofinishing operation are carried out at substantially the same total pressure, usually in the range of from about 1500 psig to about 2500 psig. However, it has been reported that in isomerization-type catalytic dewaxing operations where a silicoaluminophosphate molecular sieve is used there is improved selectivity at lower total pressures than at those pressures normally used in present commercial operations. See U.S. Pat. No. 5,082,986.

Hydrofinishing operations, such as described in U.S. Pat. Nos. 3,852,207 and 4,673,487, are intended to stabilize the lubricating base oil recovered from the dewaxer. The optimal pressure for carrying out hydrofinishing operations is relatively high, usually above about 1500 psig and more preferably above 2000 psig.

As used in this disclosure the term UV stability refers to the stability of the lubricating base oil when exposed to ultraviolet light and oxygen. Instability is indicated when the lubricating base oil forms a visible precipitate or darker color upon exposure to ultraviolet light and air which results in a cloudiness or floc in the product. Usually lubricating base oils prepared by hydrocracking followed by catalytic dewaxing require UV stabilization before they are suitable for use in the manufacture of commercial lubricating oils.

The present invention is directed to a processing scheme which makes use of the optimal conditions of each of the operations involved in the production of lubricating base oils.

SUMMARY OF THE INVENTION

In its broadest aspect, the present invention is directed to a process for producing a lubricating base oil having good UV stability from a waxy hydrocarbon feedstock which comprises dewaxing the waxy hydrocarbon feedstock in an isomerization zone in the presence of an isomerization catalyst under isomerization conditions at a total pressure of less than 1500 psig to produce a lubricating base oil product having improved lubricating base oil properties as compared to the waxy hydrocarbon feed; recovering from the isomerization zone a lubricating base oil product and light materials; increasing the pressure of the lubricating base oil product mixture to a total pressure of greater than 1500 psig; stabilizing the lubricating base oil product in a hydrofinishing zone in the presence of a hydrofinishing catalyst and hydrogen under hydrofinishing conditions at a total pressure in excess of 1500 psig to produce a UV stabilized lubricating base oil mixed with hydrogen rich off-gas; separating the UV stabilized lubricating base oil from the hydrogen rich offgas; and recovering the UV stabilized lubricating base oil. The light materials referred to as part of the mixture recovered from the isomerization zone include excess hydrogen and lighter hydrocarbons such as naphtha and the like, usually referred to as hydrogen rich off-gas, having a boiling range below that of the lubricating oil product.

The present invention is particularly useful when employed in association with a hydrocracking operation. In a preferred embodiment, the invention is directed to an integrated process for producing a lubricating base oil having good UV stability from a heavy hydrocarbon feedstock which comprises hydrocracking the heavy hydrocarbon feedstock to hydrocrackate products in a hydrocracking zone in the presence of a hydrocracking catalyst and hydrogen under hydrocracking conditions wherein said hydrocracking conditions and hydrocracking catalyst are preselected so that at least a fraction of the hydrocrackate products comprise a waxy intermediate feedstock having an initial boiling point above 650 degrees F. (340 degrees C.) and an end boiling point below the end boiling point of the heavy hydrocarbon feedstock; separating the waxy intermediate feedstock from the other hydrocrackate products produced in the hydrocracking zone and passing the waxy intermediate feedstock to a dewaxing zone; dewaxing the intermediate feedstock in a isomerization zone in the presence of a isomerizing catalyst and hydrogen under isomerization conditions at a pressure that is substantially less than the pressure present in the hydrocracking zone to produce a lubricating base oil product having improved lubricating base oil properties as compared to the waxy hydrocarbon feedstock; stabilizing the lubricating base oil product in a hydrofinishing zone in the presence of a hydrofinishing catalyst and hydrogen under hydrofinishing conditions at a pressure substantially greater than the pressure in the dewaxing zone to produce a UV stabilized lubricating base oil mixed with hydrogen rich off-gas; separating the UV stabilized lubricating base oil from the hydrogen rich off-gas in a high pressure separator; routing the hydrogen rich off-gas from the high pressure separator into the hydrocracking zone; and recovering the UV stabilized lubricating base oil. The hydrocracking zone operates at similar pressure to the high pressure hydrofinishing zone.

In carrying out the present invention, the hydrocracking and the hydrofinishing operations will usually be carried out at a total pressure in excess of 1500 psig, and preferably will be carried out at a pressure of at least 2000 psig. In carrying out the present invention the hydrocracking and hydrofinishing operations will usually be conducted at similar total pressure. However, the dewaxing operation will usually be carried out at a total pressure below 1500 psig and preferably at a pressure below about 1000 psig.

BRIEF DESCRIPTION OF THE DRAWING

The Fig. is a schematic flow diagram of one embodiment of the invention.

DETAILED DESCRIPTION OF THE INVENTION

The present invention may be more readily understood by reference to the figure. The feedstock consisting of a heavy hydrocarbon such as a vacuum gas oil is introduced via line 2 together with make up hydrogen 3 received from compressor 20 and step compressor 38 via lines 7, 9, 5, and 4, respectively, to the hydrocracking reactor 6. Make-up compressor 20 and step compressor 38 are connected by lines 21 and 23, respectively. In this embodiment of the invention, make-up compressor 20 will raise the pressure of the make-up hydrogen to the total pressure selected for operation of the isomerization operation. The step compressor 38 will raise the make-up hydrogen to the total pressure selected for the hydrocracking and hydrofinishing operations. In the hydrocracking reactor 6 the feedstock is cracked into light gases and liquid hydrocrackates, including a waxy intermediate suitable for preparing a lubricating base oil, which are collected at the bottom of the reactor and carried by outlet line 8 to the distillation unit 10. In the distillation unit 10 the overhead gases are collected and removed via overhead outlet line 12. Distillation products intended for transportation fuels are recovered separately and removed from the distillation unit via line 14 (which in actual practice may be several different streams, but are shown as a single stream for convenience). The waxy intermediate is collected and carried from the distillation unit by line 16 to a storage tank 17 where the total pressure is lowered to the pressure in the isomerizing unit. Makeup hydrogen from make-up compressor 20 is carried by lines 21 and 22 to the isomerization unit 18 along with the waxy intermediate from the storage tank 17 via line 24. In this embodiment the hydrocracking unit 6 operates at a total pressure of about 2000 psig. The isomerizing unit operates at a total pressure of less than about 1500 psig and preferably below about 1000 psig. In the isomerization unit 18 the straight and slightly branched paraffins are isomerized to more highly branched materials having a lower pour point. The products from the isomerization unit are carried by line 26 to a moderate pressure separator 28 where the overhead gases, which consist of hydrocarbons that exist as a gas at the boiling point temperature of the lubricating base oil, are recovered and removed by line 30. The lubricating base oil is collected separately in the separator 28 and sent via line 32 to booster pump 34 where the pressure of the lubricating base oil is increased to about 2000 psig or above. The lubricating base oil is carried away from the booster pump 34 under increased pressure via line 36. Make-up hydrogen from step compressor 38 is carried by lines 7 and 40 and is mixed with the lubricating base oil in line 36, and the mixture of lubricating base oil and make-up gas is introduced into the hydrofinishing reactor 42 by line 44. The conditions in the hydrofinishing unit are preselected to stabilize the lubricating base oil in the presence of oxygen and ultra-violet light. The mixture of UV stable lubricating base oil, other hydrocarbons and hydrogen is collected at the bottom of the hydrofinishing reactor 42 and carried by line 46 to a high pressure separator 48 where the overhead gases are separated from the UV stabilized lubricating base oil and are recycled to the hydrocracking unit 6 via line 50 after being mixed with additional make-up hydrogen in line 4. The UV stabilized base oil is separately collected and passed by line 52 to the lubes distillation unit 54 where the lube products 56 are separated from any residual light hydrocarbons 58. Returning to the moderate pressure separator 28, the overhead gases are collected and carried by line 30 to a cooling unit 60 in order to condense the normally liquid hydrocarbons, such as naphtha, present in the overhead gases. The condensed liquid hydrocarbons and normally gaseous fraction are carried by line 62 to a knock-out drum 64 where the gases are collected separately from the liquid hydrocarbons. The liquid hydrocarbons are carried by line 66 and line 52 to the lubes distillation unit 54. The overhead gases from the knock-out drum are recycled to the hydrocracking unit by line 68 after passing through compressor 70 which raises the pressure of the gases to that in line 5. Normally gaseous fraction and normally liquid hydrocarbons means the normal state of the materials at the prevailing temperature and pressure in the knock-out drum or a comparable separation unit.

In order to successfully route hydrogen rich gases recovered from the knock out drum 64 and the high pressure separator 48 to the hydrocracking reactor 6, it is necessary that the pressure of the hydrogen rich gases recovered from these units be slightly higher than that in the hydrocracking reactor. In the case of the gases recovered from the hydrofinishing operation, it may be desirable to operate the hydrofinishing reactor at a pressure slightly greater that in the hydrocracking zone. This would eliminate the need for an additional step of increasing the pressure of the hydrogen rich gases from the high pressure separator and eliminate the need for a compressor. In an alternative embodiment of the invention to that disclosed in the figure, compressor 70 and step compressor 38 may be combined into a single compressor.

The operating conditions in the hydrocracking zone are those typical of commercial hydrocracking operations. The temperature will be within the range of from about 500 degrees F. (260 degrees C.) to about 900 degrees F. (480 degrees C.) and preferably will be within the range of from about 650 degrees F. (345 degrees C.) to about 800 degrees F. (425 degrees C.). A total pressure above 1000 psig is used, and preferably the total pressure will be above about 1500 psig, and most preferably above about 2000 psig. Although greater maximum pressures have been reported in the literature and may be operable, the maximum practical total pressure generally will not exceed about 3000 psig. Liquid hourly space velocity (LHSV) will usually fall within the range of from about 0.2 to about 5.0, with the range from about 0.5 to about 1.0 being preferred. The supply of hydrogen (both make-up and recycle) is preferably in excess of the stoichiometric amount needed to crack the target molecules and will usually fall within the range of from about 500 to about 20,000 standard cubic feet (SCF) per barrel and will preferably be within the range from about 2000 to about 10,000 SCF per barrel.

The catalysts used in the hydrocracking zone are composed of natural and synthetic materials having hydrogenation and dehydrogenation activity. These catalyst are well known in the art and are pre-selected to crack the target molecules and produce the desired product slate. In the case of the present invention the hydrocracking catalyst will be selected to convert the heavy hydrocarbon feedstock to a product slate containing a commercially significant amount of a waxy intermediate fraction which will be upgraded to the lubricating base oil. Exemplary commercial cracking catalysts generally contain a support consisting of alumina, silica, silica-alumina composites, silica-alumina-zirconia composites, silica-alumina-titania composites, acid treated clays, crystalline aluminosilicate zeolitic molecular sieves, such as zeolite A, faujasite, zeolite X, zeolite Y, and various combinations of the above. The hydrogenation/dehydrogenation components generally consist of a metal or metal compound of Group VIII or Group VIB of the periodic table of the elements. Metals and their compounds such as, for example, cobalt, nickel, molybdenum, tungsten, platinum, palladium and combinations thereof are known hydrogenation components of hydrocracking catalysts.

Isomerization of the waxy intermediate feedstock is always carried out in the present invention at a lower total pressure than the hydrocracking operation. The isomerization operation will be conducted at a pressure below 2000 psig, preferably below about 1500 psig, and most preferably will be conducted below about 1000 psig. The minimum pressure of the isomerization operation is not critical to the operation of the present invention but will usually be conducted at a total pressure of at least 15 psig (atmospheric pressure) and more generally will be above 100 psig. The temperature of the isomerization operation will fall within the range of from about 390 degrees F. (200 degrees C.) to about 890 degrees F. (475 degrees C.), preferably from about 480 degrees F. (250 degrees C.) to about 840 degrees F. (450 degrees C.). The LHSV will generally fall within the range of from about 0.05 to about 20, preferably from about 0.1 to about 5.0, most preferably from about 0.1 to about 1.0. The hydrogen to feed ratio in the isomerization zone is typically in the range from about 500 to about 30,000 SCF per barrel of feed, preferably from about 1000 to about 20,000 SCF/barrel.

Catalysts used in the isomerization reactor will usually contain an intermediate pore size molecular sieve component consisting of either a zeolite, such as described in U.S. Pat. No. 5,053,373, or a silicoaluminophosphate, such as described in U.S. Pat. No. 5,082,986. The disclosures of U.S. Pat. Nos. 5,053,373 and 5,082,986 are herein incorporated by reference. Many of the dewaxing catalysts used in cracking-type operations also may have some isomerization activity, however catalysts used in the process that is the present invention will have primarily isomerizing activity and only minimal cracking activity under the conditions present in the dewaxing reactor. The isomerization catalyst will preferably have a hydrogenation component composed of a Group VIII metal or metal compound, such as cobalt, nickel, palladium, platinum, or mixtures thereof. As used in this disclosure the term intermediate pore size molecular sieve refers to molecular sieve with an average pore size within the range of from about 4.8 Angstrom units to about 7.1 Angstrom units.

As already noted, the total pressure in the hydrofinishing operation is higher than the pressure under which the isomerization operation is conducted, and preferably, the total pressure will be substantially the same as that in the hydrocracking operation in order to take full advantage of the present invention. In the present invention the total pressure in the hydrofinishing zone will be above 1000 psig, preferably above 1500 psig, and most preferably will be above 2000 psig. The maximum total pressure is not critical to the present invention, but due to equipment limitations the total pressure will not exceed 5000 psig and usually will not exceed about 3000 psig. Temperature ranges in the hydrofinishing zone are usually in the range of from about 300 degrees F. (150 degrees C.) to about 700 degrees F. (370 degrees C.), with temperatures of from about 400 degrees F. (205 degrees C.) to about 500 degrees F. (260 degrees C.) being preferred. The LHSV is usually within the range of from about 0.2 to about 2.0, preferably 0.2 to 1.5 and most preferably from about 0.7 to 1.0. Hydrogen is usually supplied to the hydrofinishing zone at a rate of from about 1000 to about 10,000 SCF per barrel of feed. Typically the hydrogen is fed at a rate of about 3000 SCF per barrel of feed.

Suitable hydrofinishing catalysts typically contain a Group VIII noble metal component together with an oxide support. Metals or compounds of the following metals are contemplated as useful in hydrofinishing catalysts include ruthenium, rhodium, iridium, palladium, platinum, and osmium. Preferably the metal or metals will be platinum, palladium or mixtures of platinum and palladium. The refractory oxide support usually consists of silica-alumina, silica-alumina-zirconia, and the like. Typical hydrofinishing catalysts are disclosed in U.S. Pat. Nos. 3,852,207; 4,157,294; and 4,673,487.

As noted above, the most advantageous embodiment of the present invention is when the isomerization operation and the hydrofinishing operation are integrated with a hydrocracking operation. However, one skilled in the art will recognize that the isomerization operation and hydrofinishing operation may be used in the absence of the hydrocracking operation and some desirable efficiencies will still accrue. As noted above, the yield in the isomerization reactions will be improved by operation at a significantly lower pressure than the hydrofinishing operation.

What is claimed is:

1. An integrated process for producing a lubricating base oil having good UV stability from a heavy hydrocarbon feedstock which comprises:

A. Hydrocracking the heavy hydrocarbon feedstock to hydrocrackate products in a hydrocracking zone in the presence of a hydrocracking catalyst which comprises an intermediate pore molecular sieve and hydrogen under hydrocracking conditions, which comprise a total pressure of 2000 psig or more wherein said hydrocracking conditions and hydrocracking catalyst are preselected so that at least a fraction of the hydrocrackate products comprise a waxy intermediate feedstock having an initial boiling point above 650 degrees F. and the end boiling point below the end boiling point of the heavy hydrocarbon feedstock;

B. Separating the waxy intermediate feedstock from the other hydrocrackate products produced in the hydrocracking zone and passing the waxy intermediate feedstock to a dewaxing zone;

C. Dewaxing the intermediate feedstock in an isomerization zone in the presence of a isomerization catalyst and hydrogen under isomerization conditions at a total pressure of 1000 psig or less to produce a lubricating base oil product having improved lubricating base oil properties as compared to the waxy hydrocarbon feedstock;

D. Stabilizing the lubricating base oil product in a hydrofinishing zone in the presence of a hydrofinishing catalyst and hydrogen under hydrofinishing conditions at a total pressure of 2000 psig or more to produce a UV stabilized lubricating base oil mixed with hydrogen rich off-gas;

E. Separating the UV stabilized lubricating base oil from the hydrogen rich off-gas in a high pressure separator;

F. Routing the hydrogen rich off-gas from the high pressure separator into the hydrocracking zone; and G. Recovering the UV stabilized lubricating base oil.

2. The process of claim 1 wherein the isomerization catalyst is selected from the group consisting of an intermediate pore size zeolite and an intermediate pore size silicoaluminophosphate molecular sieve.

3. The process of claim 1 including the additional steps of:

H. recovering an overhead gas from the lubricating base oil product prior to stabilizing the lubricating base oil product in the hydrofinishing zone;

I. separating from the overhead gas a hydrogen rich gas from a normally liquid fraction;

J. increasing the pressure of the hydrogen rich gas to a pressure above the pressure in the hydrocracking zone; and K. routing the hydrogen rich gas to the hydrocracking zone.

* * * * *